US009181027B2

(12) United States Patent
Diaz

(10) Patent No.: US 9,181,027 B2
(45) Date of Patent: Nov. 10, 2015

(54) TRASH RECEPTACLE SECURING SYSTEM

(76) Inventor: Jonathan Diaz, Poughkeepsie, NY (US)

( * ) Notice: Subject to any disclaimer, the term of this patent is extended or adjusted under 35 U.S.C. 154(b) by 71 days.

(21) Appl. No.: 13/484,309

(22) Filed: May 31, 2012

(65) Prior Publication Data

US 2013/0327775 A1 Dec. 12, 2013

Related U.S. Application Data

(60) Provisional application No. 61/519,886, filed on Jun. 1, 2011.

(51) Int. Cl.

| | |
|---|---|
| ***B65D 90/12*** | (2006.01) |
| ***B65F 1/12*** | (2006.01) |
| ***B65F 1/14*** | (2006.01) |

(52) U.S. Cl.

CPC ..... *B65F 1/122* (2013.01); *B65F 1/141* (2013.01); *B65F 1/1615* (2013.01)

(58) Field of Classification Search

CPC .... B65F 1/141; B65F 1/1615; Y10S 248/907; Y10S 220/908; Y10S 220/916; B62B 2202/20; B62B 1/12; B60P 7/12

USPC ..... 220/264, 475, 908, 730, 23.4, 630, 220/23.83; D34/10; 211/85.19; 248/907, 248/154, 156, 545

See application file for complete search history.

(56) References Cited

U.S. PATENT DOCUMENTS

| | | | | |
|---|---|---|---|---|
| 2,971,739 | A | 2/1961 | Kirkland | |
| 3,028,018 | A * | 4/1962 | Mott | 212/300 |
| 3,306,486 | A * | 2/1967 | Martino et al. | 220/254.3 |
| 3,679,161 | A * | 7/1972 | Husting | 248/154 |
| 4,072,286 | A * | 2/1978 | Foncannon | 248/154 |
| 4,930,653 | A * | 6/1990 | Machado | 220/23.4 |
| 4,976,371 | A * | 12/1990 | Wise et al. | 220/315 |
| 5,758,888 | A * | 6/1998 | Burgan et al. | 280/47.34 |
| 7,628,289 | B1 | 12/2009 | Boyd | |
| 2008/0135557 | A1 * | 6/2008 | Williams | 220/288 |
| 2011/0274525 | A1 * | 11/2011 | Mercier et al. | 414/406 |

* cited by examiner

*Primary Examiner* — Shawn M Braden

(74) *Attorney, Agent, or Firm* — Saile Ackerman LLC; Stephen B. Ackerman

(57) ABSTRACT

A trash receptacle securing system is provided and comprises a trash receptacle having an open top and a closed bottom. At least one aperture is formed in the closed bottom of the trash receptacle. A weighted mounting base is provided having a top surface and a bottom surface. At least one nub is formed on the top surface of the weighted mounting base with the nub receivable within the at least one aperture and releasably contactable with the closed bottom of the trash receptacle. A foot release pedal moves the at least one nub in a generally outward direction within the at least one aperture and out of contact with the closed bottom of the trash receptacle. Upon activation of the foot release pedal, the trash receptacle is separable from the weighted mounting base.

20 Claims, 5 Drawing Sheets

TRASH RECEPTACLE SECURING SYSTEM

The present application claims the benefit of priority of pending provisional patent application Ser. No. 61/519,886, filed on Jun. 1, 2011, entitled "Trash Lock".

BACKGROUND OF THE INVENTION

1. Field of the Invention

This invention relates generally to a trash receptacle securing system and, more particularly, the invention relates to a trash receptacle securing system providing garbage and recycling receptacles together with a specially designed mounting base that maintains the trash receptacle firmly in place.

2. Description of the Prior Art

As useful and necessary as outside garbage and recycling receptacles are, their use does present a couple of drawbacks. Particularly, even when these bins are loaded down with trash and other items, they can easily be knocked over. All it takes is a particularly strong gust of wind to send the container spiraling down the street, its contents sprung free from their confines to litter the landscape. The resulting mess is obviously an unpleasant job for the homeowner, who has to retrieve the rubbish strewn all over the yard and the street. Not only can it be annoying and frustrating to chase down the can and subsequently pick up the mess, but bulky, errant refuse can also present a safety hazard for oncoming traffic. If a car is forced to swerve out of the way of a garbage bag or a collection of empty milk jugs, an accident could possibly result. Outside receptacles are not only susceptible to wind. Large, stray animals searching for a quick meal can easily tip over these containers, sending the lid flying and leaving behind a backyard mess for homeowners. In addition to the risk of errant garbage, the receptacle lid itself can be irretrievably lost, resulting in people having to shell out money for replacement bins.

SUMMARY

The present invention is a trash receptacle securing system comprising a trash receptacle having an open top and a closed bottom. At least one aperture is formed in the closed bottom of the trash receptacle. A weighted mounting base is provided having a top surface and a bottom surface. At least one nub is formed on the top surface of the weighted mounting base with the nub receivable within the at least one aperture and releasably contactable with the closed bottom of the trash receptacle. A foot release mechanism moves the at least one nub in a generally outward direction within the at least one aperture and out of contact with the closed bottom of the trash receptacle. Upon activation of the foot release mechanism by means of a foot release pedal, the trash receptacle is separable from the weighted mounting base.

In addition, the present invention includes a trash receptacle securing system comprising a trash receptacle having an open top and a closed bottom. A pair of apertures is formed in the closed bottom of the trash receptacle. A weighted mounting base is provided having a top surface and a bottom surface. A pair of nubs is formed on the top surface of the weighted mounting base with one nub receivable within one aperture and each nub releasably contactable with the closed bottom of the trash receptacle. Foot release pedal moves the nubs in a generally outward direction within the apertures and out of contact with the closed bottom of the trash receptacle. A truck release mechanism is positioned on at least one side of the trash receptacle with the truck release mechanism contactable with the nubs and moveable out of contact to release the trash receptacle from the weighted mounting base. Upon activation of either the foot release pedal or the truck release mechanism, the trash receptacle is separable from the weighted mounting base.

DETAILED DESCRIPTION OF THE PREFERRED EMBODIMENTS

As illustrated in FIGS. 1-5, the present invention is a trash receptacle securing system, indicated generally at 10, providing garbage and recycling receptacles together with a specially designed mounting system that maintains a trash receptacle 12 firmly in place. The trash receptacle securing system 10 of the present invention includes the trash receptacle 12 constructed of a durable plastic material, measuring approximately four (4') feet in height and approximately twenty-eight (28") inches in width. It should be noted that while a particular size and shape trash receptacle 12 has been described and illustrated herein, it is within the scope of the present invention to provide a trash receptacle 12 of different sizes and shapes.

Figure 1A:
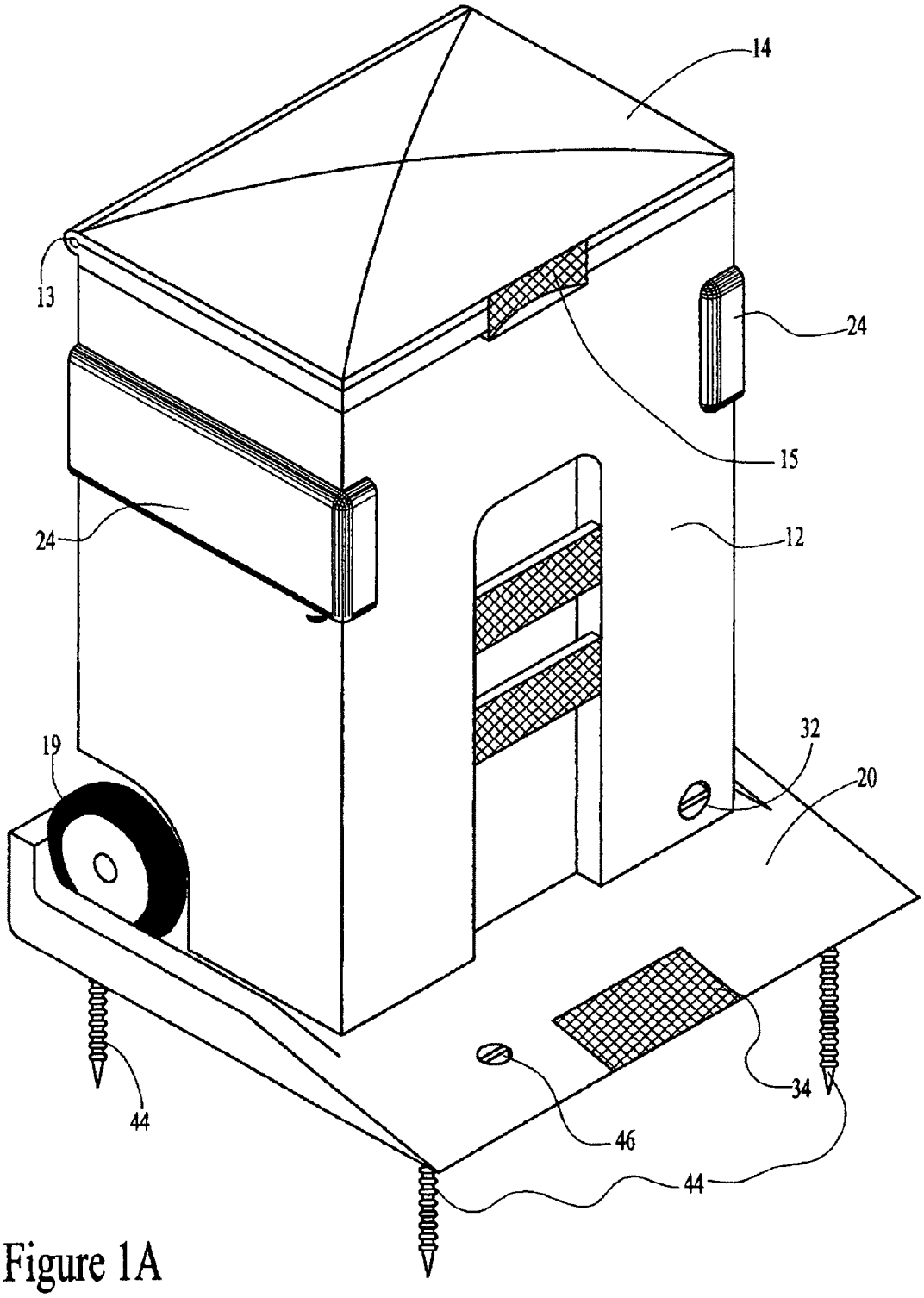
FIG. 1A is an isometric view illustrating a trash receptacle securing system, constructed in accordance with the present invention, with the trash receptacle releasably secured to a weighted mounting base.

The trash receptacle of the trash receptacle securing system 10 of the present invention comprises the trash receptacle 12 having a lid 14. The lid 12 can be hinge-mounted to the trash receptacle 12 by hinges 13 (hinge 13 is shown in FIG. 1A) so that it is not easily removed by outside interference and can also be locked by simply pushing in the snap 15 located in the front of the lid 14. On the bottom of the trash receptacle 12 is a pair of apertures 16 (shown in FIG. 2) for releasably receiving nubs or fingers 18 (shown in FIG. 3) on the weighted mounting base 20. The nubs 18 interact with the apertures 16 to releasably secure the trash receptacle 12 to the weighted mounting base 20 and are moveable to release the trash receptacle 12 from the weighted mounting base 20, as will be described in further detail below.

Figure 1B:
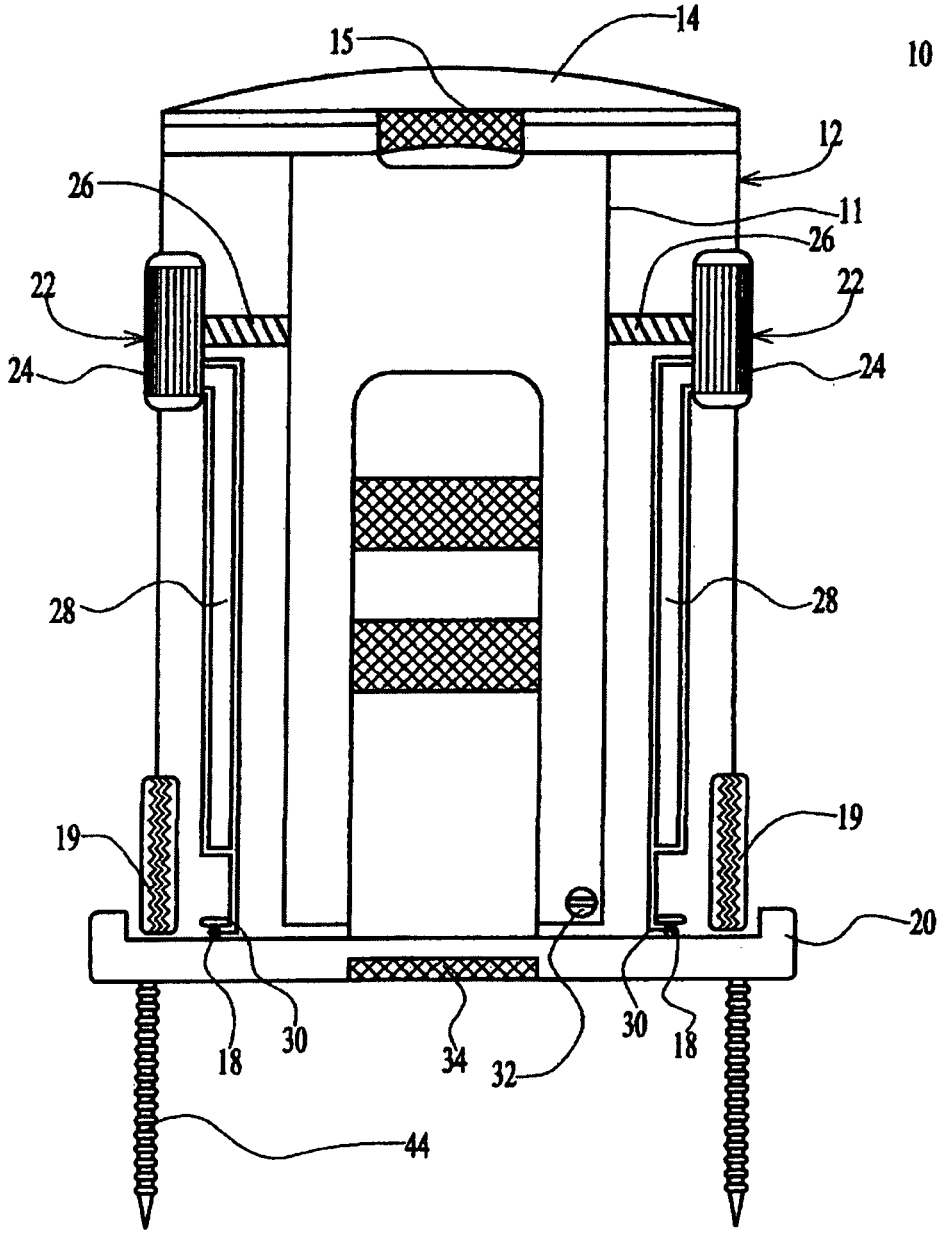
FIG. 1B is an elevational front sectional view illustrating the trash receptacle securing system. constructed in accordance with the present invention, in a locked position.
Figure 1C:
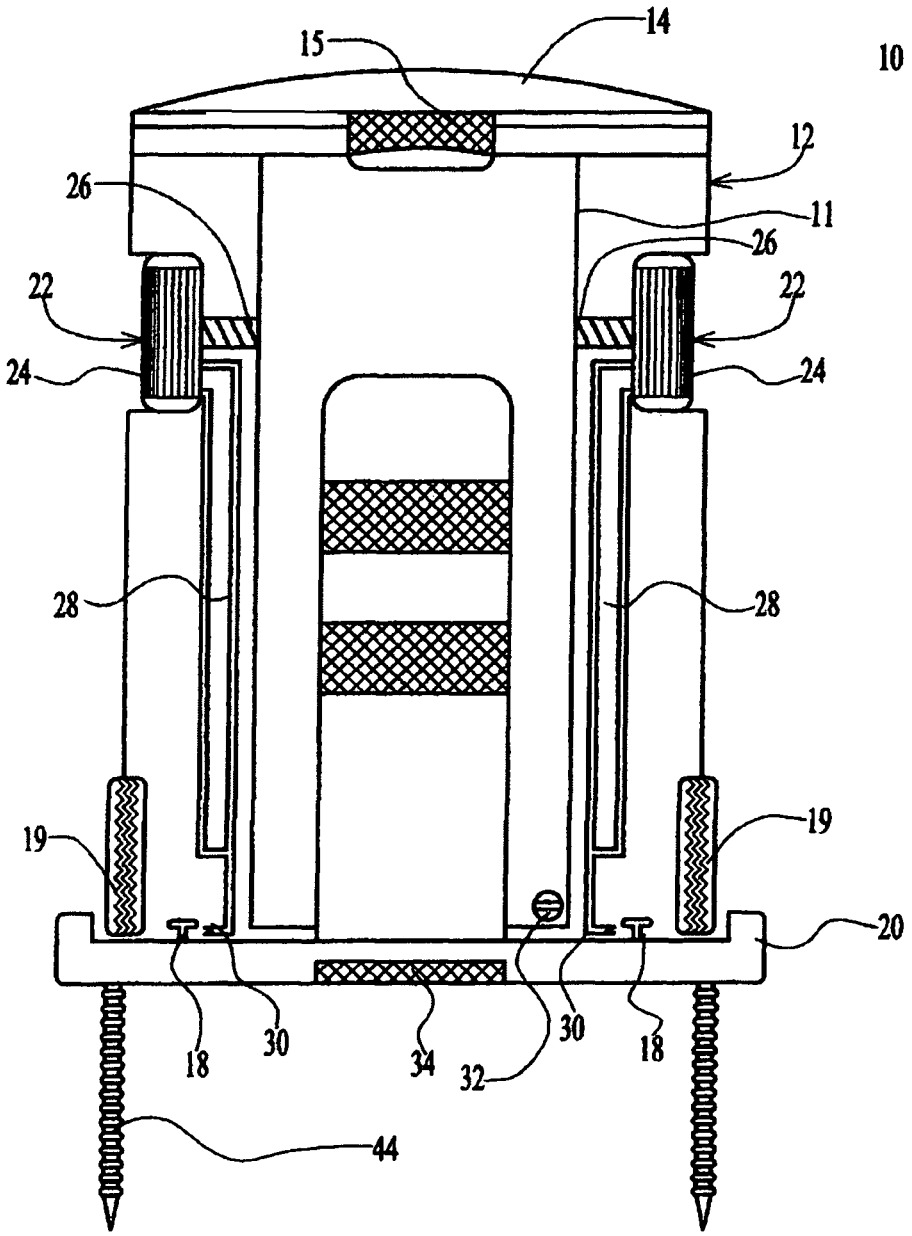
FIG. 1C is an elevational front sectional view illustrating the trash receptacle securing system, constructed in accordance with the present invention, in an unlocked position.
Figure 2:
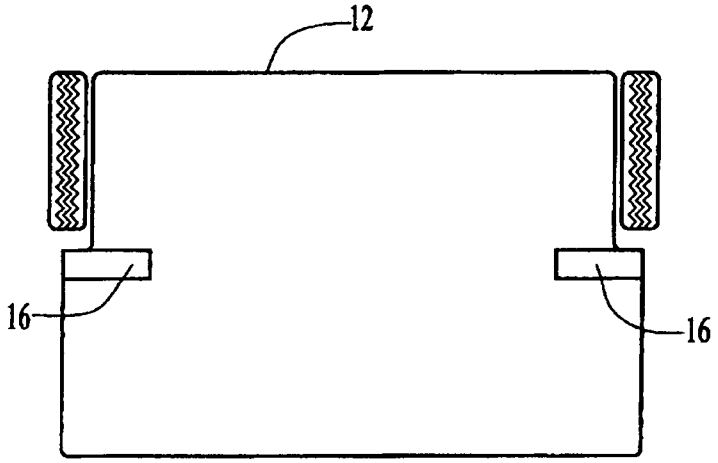
Figure 3:
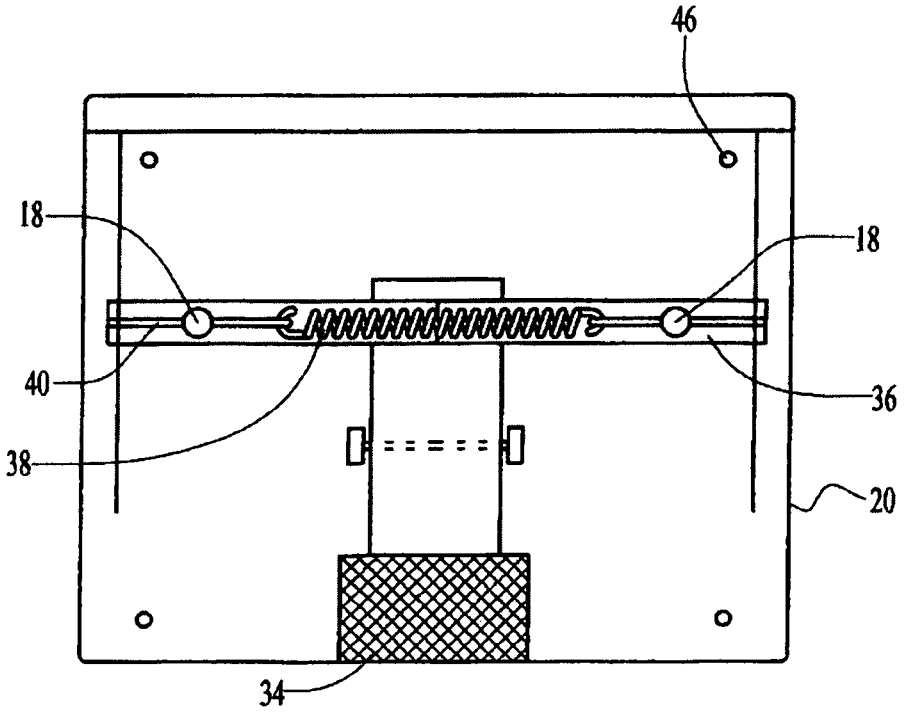
Figure 4:
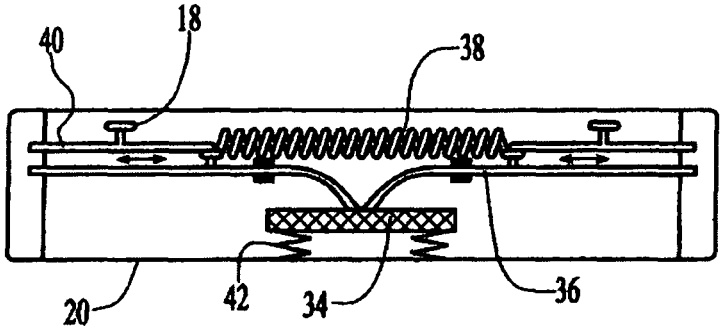
FIG. 4 is a front cross-sectional view of the weighted mounting base of the trash receptacle securing system, constructed in accordance with the present invention.
Figure 5:
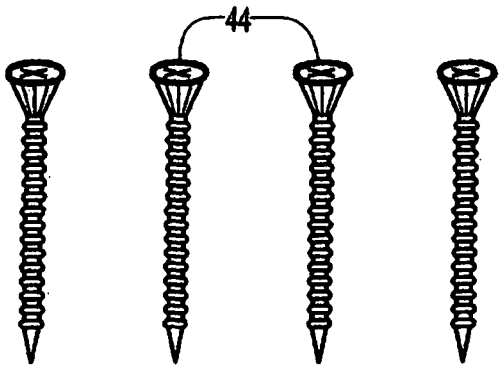
FIG. 5 is an isometric view of the ground insert rods of the trash receptacle securing system, constructed in accordance with the present invention.

In addition, the trash receptacle 12 of the trash receptacle securing system 10 of the present invention includes a truck release mechanism 22 positioned on each side of the trash receptacle 12, inside the handles 24 provided for a garbage trucks, that allows the truck to easily and expediently free the trash receptacle 12 from the weighted mounting base 20. In a preferred embodiment, the truck release mechanism 22 includes a pair of truck release buttons 22 spring-biased in a generally outward direction. A spring 26 between the truck release buttons 22 and the inside of the trash receptacle 11 accomplishes the biasing. Below the spring 26 and extending downward from each of the truck release buttons 22 is at least one securing rod 28 having a fork tine mechanism 30. In the biased position, i.e., at rest, the fork tine mechanism 30 of the securing rod 28 interacts with nub 18 on the weighted mounting base 20 thereby releasably securing the trash receptacle 12 to the weighted mounting base 20. FIG. 1B shows the nubs 18 engaged with the fork-tine mechanism 30 in the locked position. When a garbage truck presses upon the handles 24, the truck release buttons 22 inside the handles 24 are pressed, overcoming the bias of the spring 26, The fork tine mechanism 30 of the securing rod 28 releases from the nub 18 of the weighted mounting base 20 thereby releasing the securement of the trash receptacle 12 to the weighted mounting base 20. FIG. 1C shows the nubs 18 disengaged from the fork-tine mechanism 30 where the truck release buttons 22 are pushed inwards. In a preferred embodiment, the trash receptacle 12 has two securing rods 28 for added strength and improved operation. Furthermore, the bottom front left of the trash receptacle 12 has drain hole 32, having an openable and closeable cover, allowing water to drain through freely.

The trash receptacle securing system 10 of the present invention includes the weighted mounting base 20 sized and shaped to accommodate the bottom of the trash receptacle 12. The weighted mounting base 20 includes a foot release pedal 34 interacting with the nubs 18 of the weighted mounting base 20 to move the nubs 18 within the apertures 16 of the trash receptacle 12 in a general outward direction thereby disengaging the nubs 18 from the apertures 16 and fork tine mechanism 30 of the securing rods 28 of the trash receptacle 12. The interaction of the nubs 18 with the apertures 16 is accomplished with a pair of steel leaf springs 36 (shown in FIG. 4) extending from the foot release pedal 34 and connected to a heavy-duty steel spring 38 which is in turn connected to steel rods 40. The steel rods 40 are connected to the nubs 18. The heavy-duty spring 38 moves the nubs 18 back to the original position after stepping on the foot release pedal 34. Also, a foot spring 42 can be positioned under the foot release pedal 34 to move the foot release pedal 34 back to its original position.

The weighted mounting base 20 of the trash receptacle securing system 10 of the present invention has two embodiments. The first embodiment of the weighted mounting base 20 includes a series of foot-long ground insert rods 44 (as shown in FIGS. 1A, 1B, 1C, and 5) insertable through insert holes 46 formed in the weighted mounting base 20 that maintain the weighted mounting base 20 embedded into an area of lawn. Alternatively, in a second embodiment, the weighted mounting base 20 can be weighted down with approximately twenty-five (25 lbs.) pounds of sand or water for further security and has a closeable aperture 46 (as shown in FIG. 1A) allowing the weighted mounting base 20 to be filled with the sand or water. This embodiment is ideal for placing the trash receptacle securing system 10 on the side of the user's home, garage, or business on the days there is no trash pickup.

There are several significant benefits and advantages associated with the trash receptacle securing system 10 of the present invention. Foremost, the trash receptacle securing system 10 provides users with a simple and effective means of steadfastly securing outside garbage and recycling containers 12. With a uniquely designed mounting base 20, the trash receptacle securing system 10 offers a handy tool in the battle against the forces that can easily uproot these receptacles 12. Prevailing against strong gusts of wind, the trash receptacle securing system 10 effectively prevents a trash receptacle 12 from being disengaged, eliminating embarrassing chases and time-consuming clean-up of strewn garbage. Moreover, users will not have to worry that their trash will fly into the path of street traffic, causing damage to other people's cars or serving as the catalyst to an accident. The trash receptacle securing system 10 will also offer an efficient deterrent to stray animals, preventing them from accessing the contents of containers when foraging for food. Comprised of minimal components, the trash receptacle securing system 10 can be installed and ready for collection in a matter of minutes. Ideal for home use, the trash receptacle securing system 10 also proves invaluable to business establishments that employ regular outside containers for their waste collection.

The trash receptacle securing system 10 of the present invention readily enhances the convenience of outside trash and recycling bins. Keeping garbage steadfastly secured, the trash receptacle securing system 10 eliminates the hassles that can sometimes plague users of these receptacles 12.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein may be suitably practiced in the absence of the specific elements which are disclosed herein.

What is claimed is:

1. A trash receptacle securing system comprising:

a trash receptacle having an open top and a closed bottom;

at least one aperture formed in the closed bottom of the trash receptacle;

a weighted mounting base having a top surface and a bottom surface;

at least one nub formed on the top surface of the weighted mounting base, the nub receivable within the at least one aperture and releasably contactable with the closed bottom of the trash receptacle; and a foot release mechanism comprising:

a foot release pedal:

a pair of steel leaf springs extending from the foot release pedal;

a coil spring connected to the leaf springs; and steel rods connected between the coil spring and the at least one nub: wherein upon depressing the foot pedal, the at least one nub is moved in a generally outward direction within the at least one aperture and out of contact with the closed bottom of the trash receptacle wherein the trash receptacle is separable from the weighted mounting base.

2. The trash receptacle securing system of claim 1 wherein the trash receptacle has a lid, the lid being hinge-mounted to the top of the trash receptacle.

3. The trash receptacle securing system, of claim 2 wherein the lid is releasably lockable to the trash receptacle by pushing in a snap located in a front of the lid.

4. The trash receptacle securing system of claim 1 and further comprising:

a pair of apertures formed in the closed bottom of the trash receptacle; and a pair of nubs formed on the top surface of the weighted mounting base;

wherein one nub is receivable within one aperture; and wherein the foot release pedal moves both nubs in a generally outward direction within the apertures.

5. The trash receptacle securing system of claim 1 and further comprising:

a truck release mechanism positioned on at least one side of the trash receptacle for releasing the trash receptacle from the weighted mounting base.

6. The trash receptacle securing system of claim 5 wherein the truck release mechanism comprises:

a depressible truck release button mounted on the side of the trash receptacle;

a spring biasing the truck release button in a generally outward direction; and at least one securing rod having a fork tine mechanism;

wherein in a biased position, the fork tine mechanism of the securing rod interacts with the nub on the weighted mounting base thereby releasably securing the trash receptacle to the weighted mounting base; and wherein upon depressing the truck release button, the bias of the spring is overcome so that the fork tine mechanism of the securing rod releases from the nub of the weighted mounting base thereby releasing the securement of the trash receptacle to the weighted mounting base.

7. The trash receptacle securing system of claim 6 and further comprising:

a pair of truck release mechanisms, one truck release mechanism positioned on each side of the trash receptacle for releasing the trash receptacle from the weighted mounting base.

8. The trash receptacle securing system of claim 1 and further comprising:

a drain hole formed in the trash receptacle; and a cover for closing the drain hole.

9. The trash receptacle securing system of claim 1 wherein the foot release mechanism further comprises:

at least one securing rod having a fork tine mechanism contactable with the at least one nub and moveable out of contact to release the trash receptacle from the weighted mounting base.

10. The trash receptacle securing system of claim 1 and further comprising:

a foot spring positioned under the foot release pedal.

11. The trash receptacle securing system of claim 1 and further comprising:

a series of ground insert rods insertable through insert holes formed in the weighted mounting base.

12. The trash receptacle securing system of claim 1 and further comprising:

a closeable aperture formed in the weighted mounting base; and an amount of sand or water introduced into the weighted mounting base through the aperture.

13. A trash receptacle securing system comprising:

a trash receptacle having an open top and a closed bottom;

a pair of apertures formed in the closed bottom of the trash receptacle;

a weighted mounting base having a top surface and a bottom surface;

a pair of nubs formed on the top surface of the weighted mounting base, one nub receivable within one aperture, each nub releasably contactable with the closed bottom of the trash receptacle;

a foot release mechanism for moving the nubs in a generally outward direction within the apertures and out of contact with the closed bottom of the trash receptacle; and a truck release mechanism comprising a pair of truck release buttons spring-biased in a generally outward direction, wherein a spring between each trash release button and the trash receptacle accomplishes the biasing, and wherein below the spring and extending downward from each of the truck release buttons is a securing rod having a fork tine mechanism contactable with the nubs and moveable out of contact to release the trash receptacle from the weighted mounting base;

wherein upon activation of either the foot release pedal or the truck release mechanism, the trash receptacle is separable from the weighted mounting base.

14. The trash receptacle securing system of claim 13 wherein the trash receptacle has a lid, the lid being hinge-mounted and releasably lockable to the top of the trash receptacle.

15. The trash receptacle securing system of claim 13 wherein upon depressing the truck release buttons, a bias of the spring is overcome so that the fork tine mechanism of the securing rod releases from the nub of the weighted mounting base thereby releasing the securement of the trash receptacle to the weighted mounting base.

16. The trash receptacle securing system of claim 13 wherein one truck release button is positioned on each side of the trash receptacle for releasing the trash receptacle from the weighted mounting base.

17. The trash receptacle securing system of claim 13 wherein the foot release mechanism comprises:

a foot release pedal;

a pair of steel leaf springs extending from the foot release pedal;

a coil spring connected to the leaf springs; and steel rods connected between the coil spring and the nubs;

wherein upon depressing the foot pedal, the nubs are moved within the apertures thereby disengaging the nubs from the apertures and fork tine mechanisms of the securing rods of the trash receptacle.

18. The trash receptacle securing system of claim 17 and further comprising:

a foot spring positioned under the foot release pedal.

19. The trash receptacle securing system of claim 13 and further comprising:

a series of ground insert rods insertable through insert holes formed in the weighted mounting base.

20. The trash receptacle securing system of claim 13 and further comprising:

a closeable aperture formed in the weighted mounting base; and an amount of sand or water introduced into the weighted mounting base through the aperture.

* * * * *